United States Patent [19]

Erickson

[11] 4,329,789

[45] May 18, 1982

[54] FOOD DRYER

[76] Inventor: Keith D. Erickson, 1170 Elgin Ave., Salt Lake City, Utah 84106

[21] Appl. No.: 152,740

[22] Filed: May 23, 1980

[51] Int. Cl.[3] ..... F26B 9/10

[52] U.S. Cl. ..... 34/195; 34/93; 99/483; 108/111; 211/113; 312/5; 312/236

[58] Field of Search ..... 312/1, 3, 5, 236; 34/192, 195, 196, 197, 93; 99/516, 483; 108/111, 149; 211/113

[56] References Cited

U.S. PATENT DOCUMENTS

| | | | |
|---|---|---|---|
| 1,227,723 | 5/1917 | Wilson | 108/149 |
| 2,244,887 | 6/1941 | Manley | 108/149 |
| 2,440,192 | 4/1948 | Cowan | 312/6 |
| 2,975,529 | 3/1961 | Weber | 34/151 |

FOREIGN PATENT DOCUMENTS

| | | | |
|---|---|---|---|
| 1129305 | 9/1956 | France | 312/5 |
| 17437 | 3/1911 | United Kingdom . | |

*Primary Examiner*—Larry I. Schwartz
*Attorney, Agent, or Firm*—B. Deon Criddle

[57] ABSTRACT

A portable, lightweight and compact food dryer. The invention comprises a collapsing frame and tiers of lightweight trays enclosed by a net housing and covered by a heat absorbing roof. The collapsing frame includes a metal hook protruding vertically out of the roof, a metal collar providing support for the net housing, and several support straps. The support straps attach to the shank of the hook at the apex of the roof, thereafter passing out over the metal collar and vertically down inside the net housing. Preferably, all but the last tray attach at regular intervals to the vertical straps. The last tray preferably rests on the base of the net housing.

In use, the food dryer may be suspended wherever deemed most convenient. A zipper in the net housing allows easy access to the trays which may be removed and cleaned whenever desired. When not in use, the dryer is readily collapsed for convenient storage.

5 Claims, 4 Drawing Figures

FOOD DRYER

BRIEF DESCRIPTION OF THE INVENTION

1. Field of the Invention

This invention relates to food drying devices, particularly, those such devices that will operate "naturally", i.e. without requiring artifically produced heat or wind sources.

2. Prior Art

In the past, most homemade "natural" food dryers have consisted of nothing more than a wire screen or tray base on which food to be dried is placed. The base is then outside with a wire positioned to expose the contents to sunlight and a wire screen cover may be placed thereover. The wire screen cover provides protection from birds and breezes. These simple homemade dryers have often proven to be bulky as well as difficult to handle and inconvenient to clean and store. In addition, they actually provide little protection for the food placed from contamination by insects such as ants, flies and gnats, birds and animals.

U.S. Pat. No. 1,300,670 shows an evaporator to be used for the drying of various types of fruits and vegetables. The evaporator is formed of a rigid box having support legs and with mesh sides to provide for ventilation and glass ends, top and bottom to permit sunrays therethrough.

U.S. Pat. No. 1,362,216 also shows a sun fruit dryer formed of a rigid box having support legs. Inclined glass roof faces are provided to receive sunlight and upper and lower vent openings are provided for ventilation purposes.

U.S. Pat. No. 1,538,957 shows an evaporator having a box or pan in which foodstuffs to be dried is placed and a glass cover through sunlight is passed and on the bottom of which cover moisture will condense before running off.

Most other conventional food dryers depend on the operation of a fan and/or a heat source to accelerate the drying process. Such dryers are frequently noisy, require a considerable amount of maintenance and involve undesirable operating costs. Furthermore, such devices are commonly housed in box-like structures that are inconvenient to move and store.

SUMMARY OF THE INVENTION

1. Objects of the Invention

Principal objects of the present invention are to provide a lightweight, compact, and portable food dryer. A further object of the invention is to protect drying food from birds, animals, insects and strong breezes. Yet another object of the invention is to eliminate maintenance and energy costs common to many conventional food dryers.

2. Features of the Invention

Important features of the present invention include a collapsing frame and several tiers of lightweight trays enclosed by a net housing and covered by a plastic roof. The collapsing frame includes a metal hook protruding vertically out of the plastic roof, a metal collar providing support for the net housing, and several support straps. The support straps attach to the foot of the hook at the apex of the plastic roof; thereafter passing out over the metal collar and vertically down inside the net housing. In the preferred embodiment, all but one of the trays attach by snaps to the support straps at regular intervals along the straps. The last tray merely rests on the base of the net housing.

Another important feature of the present invention is a zipper running the length of the net housing and providing easy access to the trays within.

Additional objects and features will become apparent from the following detailed description and claims, taken together with the accompanying drawings.

THE DRAWINGS

FIG. 1 is a pictorial view of the food dryer of the present invention;

FIG. 2, a front elevation view of the food dryer of the present invention;

FIG. 3, a transverse horizontal section taken on the line 3—3 of FIG. 1; and FIG. 4, a similar view taken on the line of 4—4 of FIG. 1.

DETAILED DESCRIPTION

Figure 1:
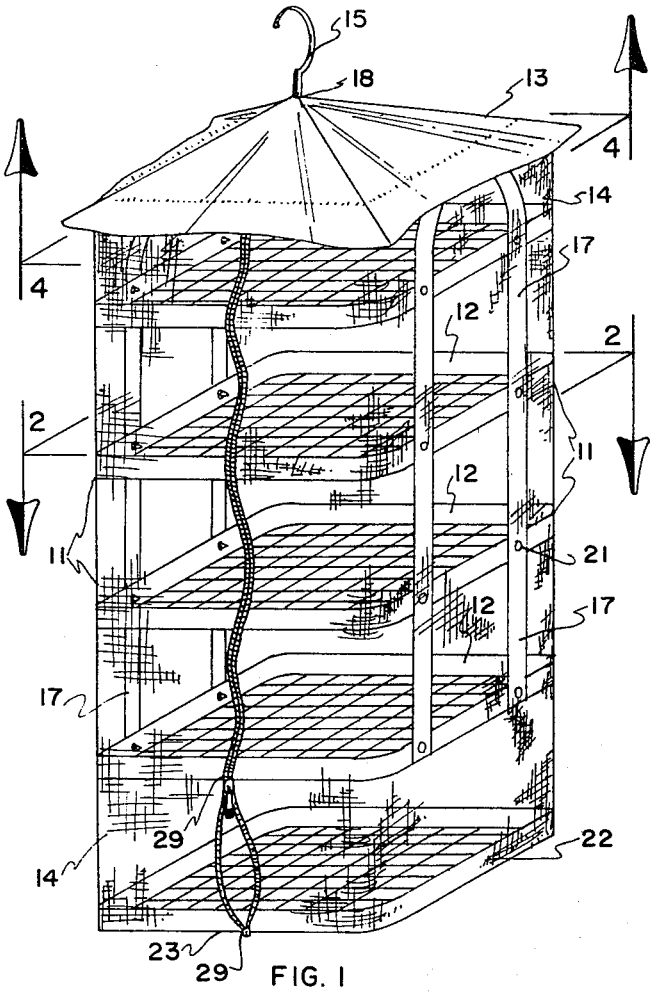
Figure 4:
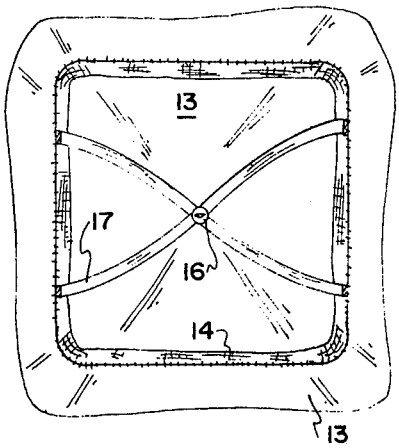
Figure 2:
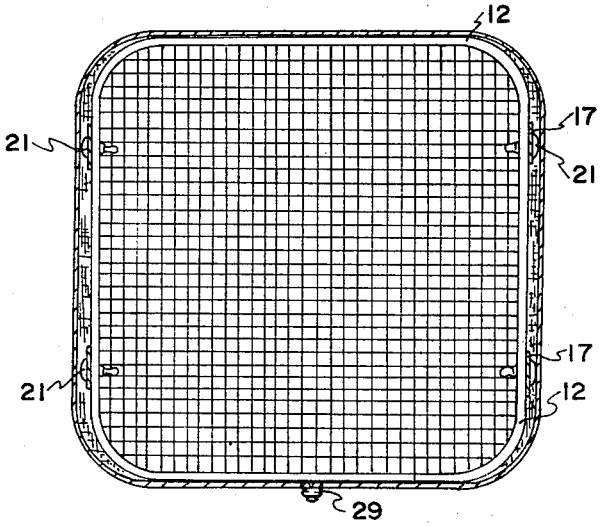
Figure 3:
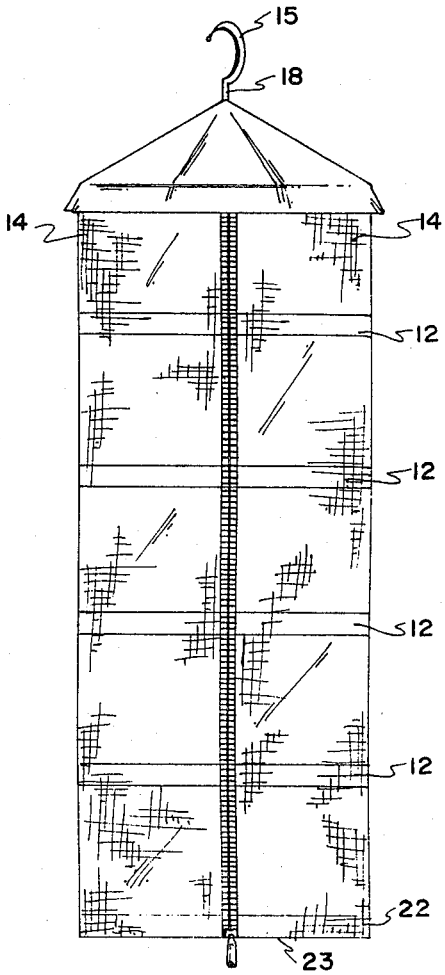

Referring now to the drawings:

In the preferred embodiment of FIGS. 1—3, the food dryer 10 comprises a collapsing frame 11 and several tiers of spaced apart lightweight trays 12 covered by a roof 13, made of a heat absorbing sheet material such as plastic, and enclosed within a net housing 14.

The collapsing frame 11 includes a metal hook 15, a metal collar 16, and four support straps 17. The shank 18 of the metal hook 15 passes down through the apex 19 of the plastic roof 13 where the foot 20 of the hook 15 attaches to the support straps 17. The support straps 17 pass out over and are attached to the metal collar 16 and extend vertically down inside the net housing 14. All but one of the trays 12 are attached by snaps 21 to the support straps 17 at regular intervals along the straps 17. In the preferred embodiment shown, the last tray 22 rests on the base 23 of the net housing 14.

The snaps 21 each include a head 24 and a resilient, split shank 25. The shanks are inserted through holes 26 in the support straps 17 so that the heads 24 rest against the straps and the shanks extend through holes 27 of upturned sidewalls of the trays and spread to hold the trays to the support straps.

As best shown in FIG. 2, the net housing 14 may be opened and closed by means of a zipper 29, that provides easy access to the trays 12.

In use, the food dryer 10 may be suspended wherever desired by the hook 15 and food may be placed on the trays 12. During drying, the net housing 14 provides protection from birds, animals, insects and heavy winds, while permitting good air circulation so that spoilage will not occur. When drying is completed, the trays 12 are readily unsnapped and cleaned. The dryer 10 may then be reused or stored. The dryer is generally collapsed for storage merely by moving the trays and roof together and folding the net housing into the trays.

The trays 12 each have a perforated food support surface to provide for good air circulation and are preferably made of a material that is easily cleaned. It has been found that injection molded trays made of suitable plastics for example are economical to produce and also can be readily cleaned by hand or in a dishwasher. The trays are easily removed merely by pulling out snaps 21 for such cleaning or for replacement, if necessary.

The materials from which the trays, net and roof are made are all preferably black in color to more effectively absorb and hold heat from the sun and to thereby better effectuate drying of foodstuffs placed on the trays.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A food dryer comprising a collapsible frame including a hook a plurality of spaced apart flexible support straps fixed to and adapted to be suspended from said hook;

a collar carried by the hook;

a plurality of spaced apart, tiered trays, each having a perforated food support surface surrounded by an upstanding peripheral edge;

means for holding said trays in said spaced relationship;

a net housing surrounding the peripheral edge of each tray to permit air through the housing to contents of the tray and carried by the frame, one of said trays forming a bottom for said net housing whereby air will circulate upwardly through the tiered trays;

means for releasably attaching at least one of the trays to the support straps;

a heat absorbing roof of flexible sheet material carried by the collar and straps and extending over the tier of trays; and means for opening and closing said net housing to provide access to and removal of each of said trays.

2. A food dryer as in claim 1, wherein the means for attaching at least one of the trays to the support straps comprises snaps to removably secure said tray to said straps.

3. A food dryer as in claim 1, wherein a plurality of trays spaced one above the other are removably attached to said straps.

4. A food dryer comprising a collapsible frame including a hook a plurality of spaced apart flexible support straps fixed to and adapted to be suspended from said hook;

a collar carried by the hook;

a plurality of spaced apart, tiered trays, each having a perforated food support surface surrounded by a peripheral edge;

means for holding said trays in said spaced relationship;

a net housing surrounding the peripheral edge of each tray to permit air through the housing to the contents of the tray and carried by the frame, one of said trays forming a bottom for and carried by said net housing whereby air will circulate upwardly through the tiered trays;

means for releasably attaching the other of said trays to the support straps above the tray carried by the bottom of the net housing;

a heat absorbing roof of sheet material carried by the collar and straps and extending over the tier of trays; and means for opening and closing said net housing to provide access to and removal of each of said trays.

5. A food dryer as in claim 4, wherein the means for opening and closing said net housing comprises a zipper.

* * * * *